United States Patent [19]

Ward et al.

[11] 4,103,636

[45] Aug. 1, 1978

[54] METHOD FOR INSERTING SEAMS IN BASE FABRIC

[75] Inventors: Gerald Frank Ward; Gordon Richard Wray, both of Loughborough, England

[73] Assignee: National Research Development Corporation, London, England

[21] Appl. No.: 778,923

[22] Filed: Mar. 18, 1977

Related U.S. Application Data

[60] Division of Ser. No. 509,021, Sep. 24, 1974, Pat. No. 4,041,884, which is a continuation of Ser. No. 883,876, Dec. 10, 1969, abandoned.

[30] Foreign Application Priority Data

Dec. 10, 1969 [GB] United Kingdom ..... 1623/69

[51] Int. Cl.[2] ..... D05C 15/04

[52] U.S. Cl. ..... 112/266; 112/197

[58] Field of Search ..... 112/266, 262, 79 A, 112/79 R, 165, 206, 213, 197, 198, 410

[56] References Cited

U.S. PATENT DOCUMENTS

| | | | |
|---|---|---|---|
| 10,354 | 12/1853 | Blodgett | 112/197 |
| 2,298,750 | 10/1942 | Christensen et al. | 112/206 X |
| 3,361,096 | 1/1968 | Watkins | 112/79 R |
| 3,428,007 | 2/1969 | Wignall et al. | 112/410 X |

FOREIGN PATENT DOCUMENTS

| | | | |
|---|---|---|---|
| 43,095 | 5/1887 | Fed. Rep. of Germany | 112/197 |
| 347 of | 1852 | United Kingdom | 112/79 R |
| 787,151 | 12/1957 | United Kingdom | 112/206 |

*Primary Examiner*—H. Hampton Hunter

*Attorney, Agent, or Firm*—Cushman, Darby & Cushman

[57] ABSTRACT

Apparatus for making a seam from two threads, each thread being formed into bridging loops and prone loops, each prone loop of one thread embracing a doubled portion between two bridging loops of the other thread, such doubled portions forming the prone loops. The apparatus has opposed sewing-machine-type needles which move together and apart, crossing a reference plane between the needles in a pattern whereby a loop between the eye of one needle and the previously made seam, is penetrated when the first needle starts to retreat from its furthermost excursion past the reference plane, by the other needle during its approach to the reference plane. The needles of a pair are slightly staggered laterally so that they pass one another, preferably with light contact, during loop penetration.

The example relates to a seam which is made upon a base fabric and in which the bridging loops of both threads are held slack to form pile loops by means of loopers.

3 Claims, 12 Drawing Figures

METHOD FOR INSERTING SEAMS IN BASE FABRIC

This is a division of application Ser. No. 509,021 filed Sept. 24, 1974, now U.S. Pat. No. 4,041,884 dated Aug. 16, 1977 which in turn a continuation of application Ser. No. 883,876 filed Dec. 10, 1969, now abandoned.

This invention relates to a machine for inserting seams in base fabric.

One of the various objects of the present invention is to provide an improved tufted fabric which can be readily and inexpensively produced and in which the tufting is well anchored in the fabric.

Another object of the invention is the insertion of reinforcement seams in a base fabric, for instance a non-woven fabric.

According to the invention there is provided apparatus for making a seam on a base fabric with a first thread and a second thread, one thread providing on one side of the fabric an array of bridging loops, doubled portions of the thread between adjacent bridging loops passing through the fabric to provide, on the other side of the base fabric, prone loops, and the other thread providing, on said other side of the base fabric an array of bridging loops and on the said one side of the base fabric, prone loops, the prone loops of one thread encircling and anchored by doubled portions between adjacent bridging loops of the other thread, the machine comprising a pair of sewing needles one situated on a first side of a datum plane fabric and the other situated on a second side of the datum plane and with mounting means for the needles of the pair adapted to advance, first one needle of the pair and then the other needle of the pair, towards and beyond the datum plane and so on alternately, a thread from a thread package passing through the eye of each needle of a pair whereby each needle carries a loop of thread which it inserts, first, and before passing through the datum plane, through a loop in the eye of the other needle of the pair which other needle has at that time passed through the datum plane, and secondly beyond the datum plane in turn to form a loop similarly penetrated by the other needle after it has withdrawn from the datum plane and again started to advance towards the datum plane.

Preferably a secondary motion is imparted to the needles so that each needle, when it is penetrating a base fabric located in the datum plane, advances warpwise of the base fabric substantially at a predetermined constant speed of advance of the base fabric and, when the needle is withdrawn from the base fabric, retreats upstream of the warpwise motion of the base fabric.

The invention is illustrated by embodiments designed to produce tufted seams, for instance a number of closely-spaced parallel seams to simulate a terry cloth, but the invention is not confined to such applications and may be used for reinforcement by seams of a fabric such as an unwoven fabric or for other analogous applications.

The invention will be more readily understood from the following description of certain embodiments thereof illustrated in the accompanying drawings in which.

Figure 1:
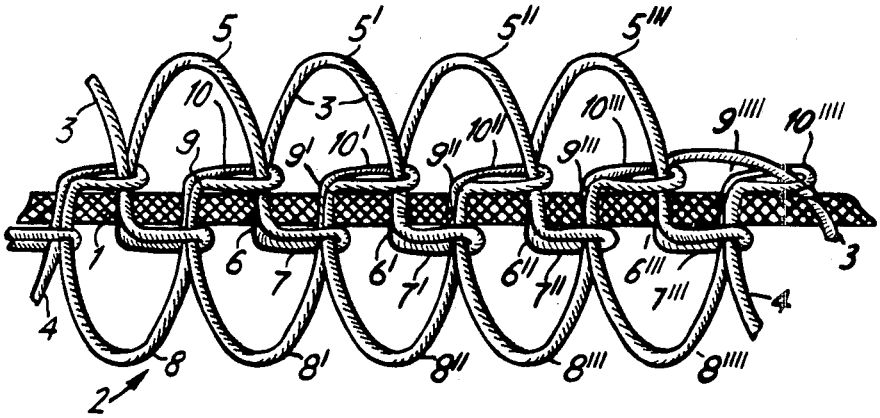
FIG. 1 shows one of the tufting seams of a tufted fabric with the base fabric in cross-section.
Figure 2:
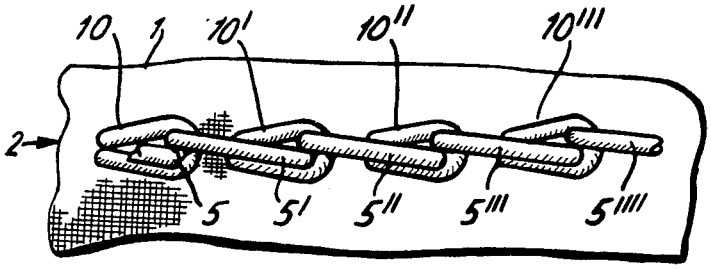
FIG. 2 shows the seam of FIG. 1 in plan view.

FIG. 1 shows the base fabric 1 in cross-section and one of the tufting seams generally indicated at 2. The fabric 1 may be woven or unwoven and will carry a number of closely spaced tufting seams (each like the seam 2), preferably parallel to one another and covering substantially the whole of the fabric 1, to give a simulation of terry cloth.

The seam 2 consists of two threads 3 and 4.

The thread 3 provides on the upper side of the fabric 1 an array of upstanding pile loops 5, 5', 5" —. Doubled portions 6, 6', 6" — of the thread 3, between the loops 5, 5'; 5', 5"; 5" —, pass through the fabric 1 to provide, on the under side of the fabric 1, prone loops 7, 7', 7" — lying along the surface of the fabric 1.

Similarly the thread 4 provides on the under side of the fabric 1 an array of upstanding pile loops 8, 8', 8" —. Doubled portions 9, 9', 9" — of the thread 4, between the loops 8, 8'; 8', 8"; 8" —, pass through the fabric 1 to provide, on the upper side of the fabric 1, prone loops 10, 10', 10" — lying along the upper surface of the fabric 1.

Each of the loops 10, 10', 10" — encircles an adjacent one of the doubled portions 6, 6', 6" — of the thread 3, whereas each of the loops 7, 7', 7" — encircles an adjacent one of the doubled portions 9 of the thread 4. The tufting constituted by the loops 5, 5', 5" — and 8, 8', 8" — is thus well anchored in the fabric 1. As will be explained later, the pile loops of one or both of the threads, e.g. loops 5, 5', 5" — of thread 3 and/or loops 8, 8', 8" — of thread 4, may be drawn flat against the surface of the base fabric so that there is no upstanding pile or an upstanding pile on one surface of the fabric only.

The loops 5, 5', 5" — and 8, 8', 8" — may be described as "bridging loops" because the two legs of each such loop emerge from the base fabric at different points, whereas the two legs of a prone loop emerge from the base fabric through a single hole therein.

FIGS. 3 to 8 inclusive show successive stages of a complete cycle of seam formation, the cycle being repeated along the length of the seam 2, as the base fabric 1 progresses through the tuft insertion zone generally indicated at 11. These Figures show the seam of FIG. 1 in various stages of the formation of loops 8'" and 5'".

Figure 8:
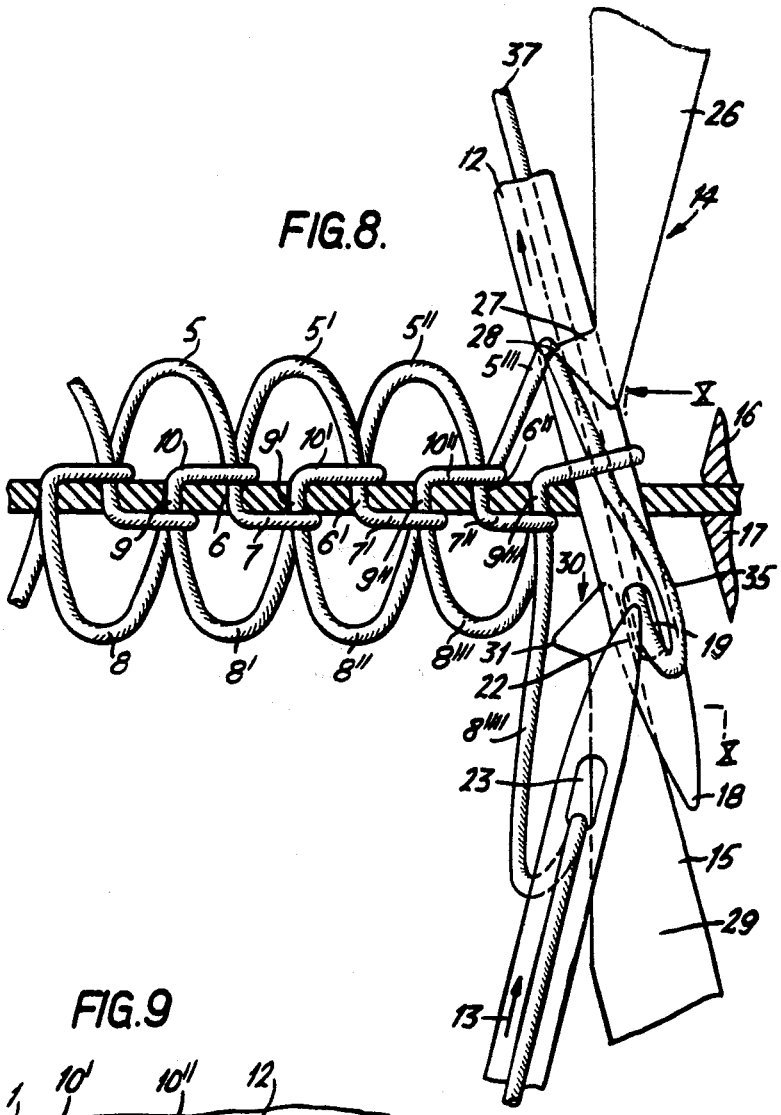
Figure 10:
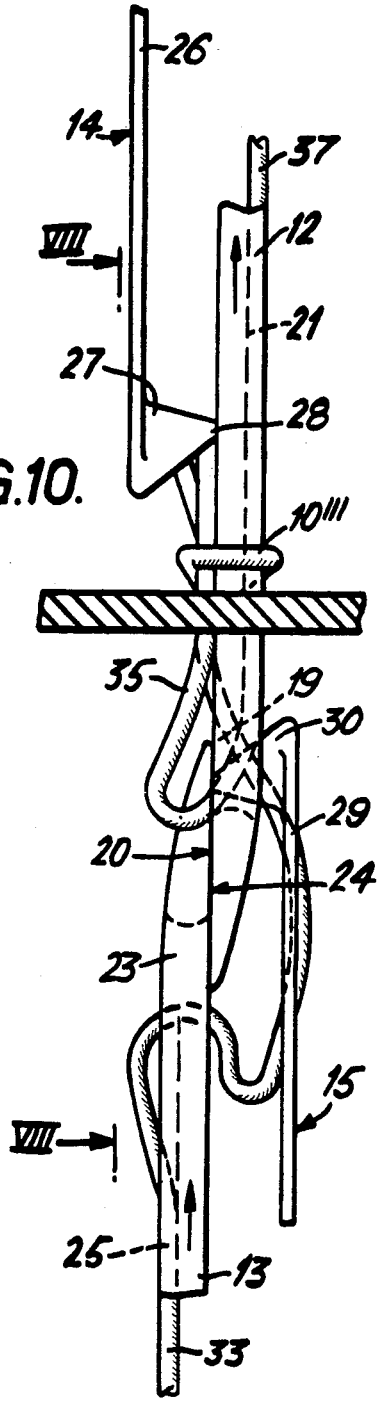
FIG. 10 shows the said machine sectioned in a plane weftwise of the base fabric and normal to the surface thereof.

The nature of the machine can best be seen from FIGS. 8 and 10, FIG. 10 being a section through the line X — X of FIG. 8 and FIG. 8 being a section through the line VIII — VIII of FIG. 10.

The apparatus comprises upper and lower needles 12 and 13 respectively, upper and lower thread-controlling fingers or loopers 14 and 15 respectively, and two stationary guide bars 16 and 17.

The upper needle 12 has a tapering tip 18 for piercing the base fabric 1 and an oval eye 19 which extends through it from front to back as seen in FIG. 8. It has an oval cross-section above the eye 19, a flat vertical face 20 (FIG. 10) on the side adjacent to needle 13 and a longitudinal groove 21, along the shank to the eye 19, in its other side. The lower needle 13 similarly, has a tapering tip 22 for piercing the base fabric 1 and an oval eye 23 which extends through it from front to back as seen in FIG. 8. It has an oval cross-section below the eye 23, a flat vertical face 24 (FIG. 10), on the side adjacent to needle 12, and a longitudinal groove 25, along the shank, to the eye 23 in its other side.

Each of the needles 12, 13 is mounted for axial movement, which will be called the primary needle motion, and also a component of motion warpwise of the base fabric 1 is provided and this will be called the secondary needle motion.

As will be seen from FIG. 10 the faces 20 and 24 lie substantially in the same plane so that the face 20 is in sliding contact with the face 24.

The finger 14 (FIG. 8) is made largely of sheet metal. It has a shank 26 secured to a fixed part of the machine with provision for adjustment of the position and attitude of the end thereof nearest to the base fabric 1. The shank 26 terminates in a generally triangular nib 27, which is bent from the shank 26 and terminates in a pointed nose 28. Nib 27 is placed so as to intercept the thread 3 extending from the eye 19 of needle 12 as it moves towards the base fabric 1 after its maximum excursion, (see FIG. 4), from the base fabric 1. This interception can be seen in FIGS. 5, 6 and 7.

Similarly, the finger 15 is made largely of a sheet metal. It has a shank 29 secured to a fixed part of the machine with provision for adjustment, of the position and attitude of the end thereof nearest to the base fabric 1. The shank 29 terminates in a generally triangular nib 30 which is bent from the shank 29 and terminates in a pointed nose 31. Nib 30 is placed so as to intercept the thread 4, extending from the eye 23 of needle 13 as it moves toward the base fabric 1 after its maximum excursion, (see FIG. 7), from the base fabric 1. This interception can be seen from FIGS. 8, 3 and 4 (in that order).

The guide bars 16 and 17 are secured to a fixed part of the machine with provision for adjustment to vary their separation. In the drawings they are shown spaced apart just sufficiently to allow the base fabric 1 to slide readily through between them. They serve to hold the base fabric 1 in the required position for the operation of the needles 12 and 13 and to support it against the piercing thrust of the needles.

The base fabric 1 is kept taut and fed forwards (i.e. from right to left) viewing FIGS. 3 to 8 from a supply roll at a constant rate by means such as those described below in relation to FIG. 12.

Figure 3:
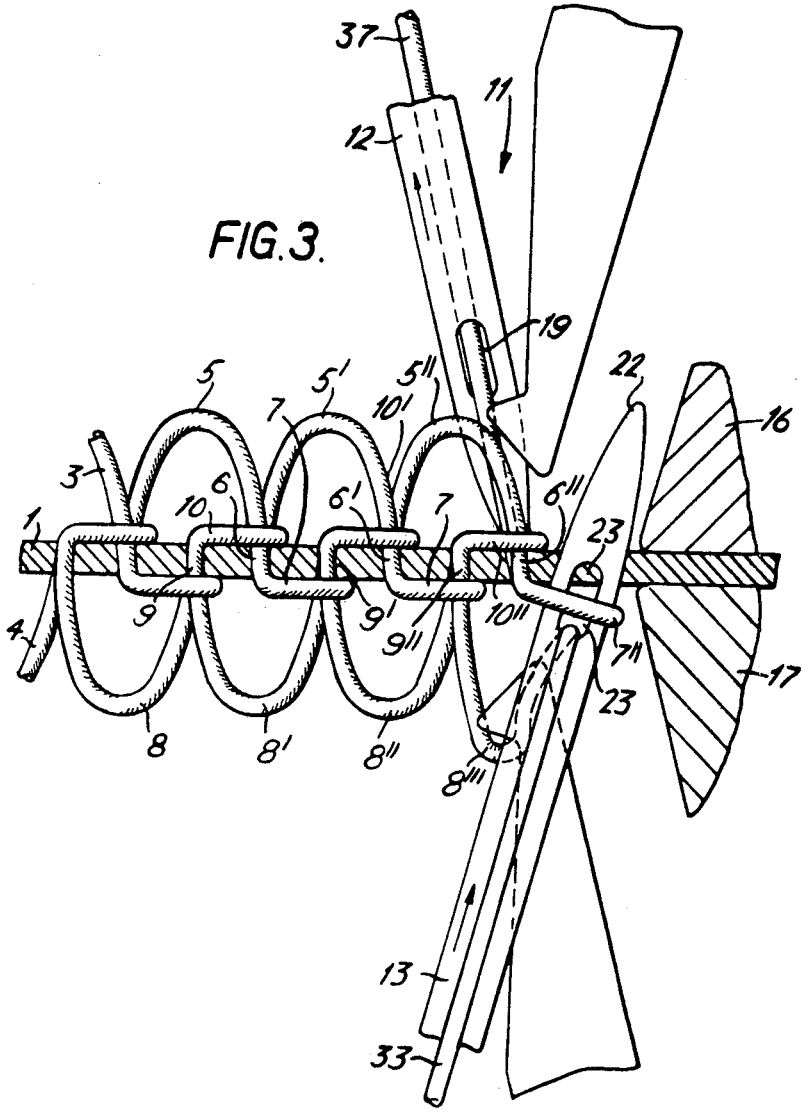
FIGS. 3 to 8 show an embodiment of a machine according to the invention, adapted for making the seam shown in FIGS. 1 and 2, sectioned along a seam with the two needles of a pair in different attitudes corresponding to different points in the cycle of their operation.
Figure 11:
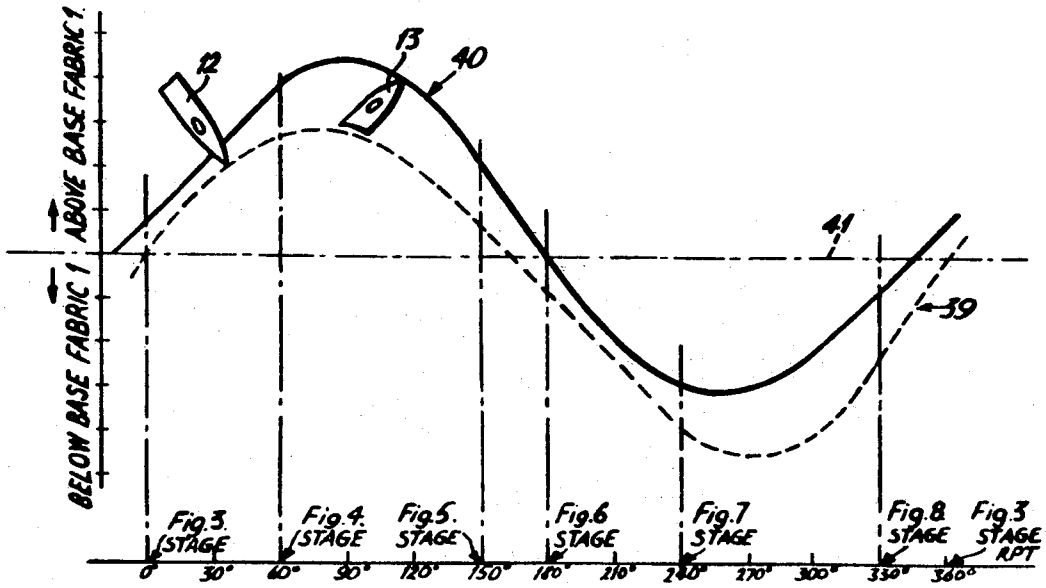
FIG. 11 shows a cycle diagram of a pair of needles of the said machine.

FIGS. 3, 4, 5, 6, 7 and 8 show the positions of the needles 12 and 13 and of the seam 1 and of the formation of loops from threads 3 and 4, at the six stages corresponding to 0°, 60°, 150°, 180°, 240° and 330°, positions in one cycle of the machine shaft (not shown), these positions being shown by the lines *a, b, c, d, e* and *f* in FIG. 11. For the purposes of the following description the cycle will be regarded as starting with the 0° position (FIG. 3).

At about 15° of rotation of the main shaft before the FIG. 3 stage, (that is to say at a stage between that of FIG. 8 and that of FIG. 3), the tip 22 of the needle 13 first passes through the prone loop 7″ in a manner which can be seen from FIG. 8 where the same process can be seen just about to happen for a succeeding prone loop 7‴. Needle 13 then pierces the base fabric 1 from below, and thereafter upward movement of the needle 13 causes the eye 23 to carry a doubled portion of the thread 4 through the base fabric 1 (FIG. 4) so that it projects above the base fabric 1 in the form of a loop 32 with a length 33 of the thread 4 extending from one end of the loop 32 through the base fabric 1 along the groove 25 in the needle 13 and to a thread supply (not shown) and a length 34 of the thread 4 extending from the other end of the loop 32 through the base fabric 1 and joining a doubled portion 9″ of the thread 4, this doubled portion projecting upwards through the base fabric 1 and providing a prone loop 10″ lying along the upper face of the base fabric 1.

Figure 4:
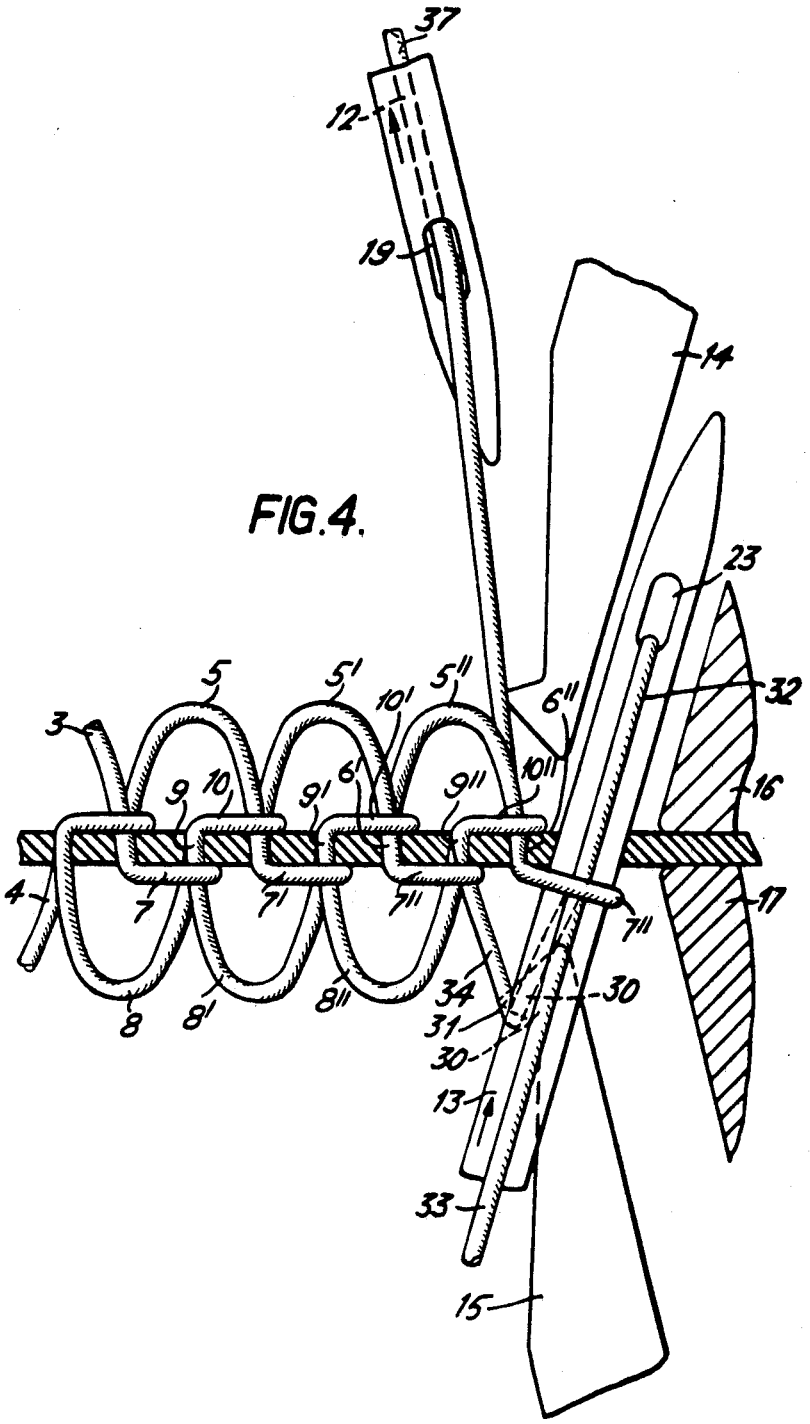

At the FIG. 4 stage the length 34 of the thread 4 has been caught on the nib 30 of the finger 15. The finger 15 thus holds the length 34 of the thread 4 against being drawn close against the underface of the base fabric 1 as the needle rises, so as to leave the length 34 (after it has moved to the left off the nose 31 as the base fabric 1 is fed to the left) in the form of an upstanding pile loop 8‴ in succession to the previously formed bridging loops 8, 8′ and 8″.

From an examination of the timing chart of FIG. 11, in which the dash line 39 refers to the position of the tip of the needle 12, the full line 40 refers to the position of the tip of the needle 13, and the horizontal chain line 41 represents the position of the base fabric 1, it will be seen that the needle 13, after its tip has entered the base fabric 1 at 15° before the FIG. 3 stage, rises to its greatest height at about 90° and then has a downward movement until at 150° (FIG. 5) it is lower than in FIG. 4. Such downward movement of the needle 13 allows the loop 32 to slacken to enable the needle 12, very shortly after the 150° position (FIG. 5), in its downward movement, to enter the loop 32 and prevent its being pulled back down through the base fabric 1 by further downward movement of the needle 13 and by the action of take-up mechanism, described in relation to FIG. 12, which operates on the length 33 of the thread 4 to tighten the loop 32 about the needle 12 so as to form prone loop 10‴.

Prone loop 10‴ is not finally cast off by needle 12 until that needle is withdrawn from the fabric after the stages of FIGS. 5, 6, 7 and 8, followed by the next repetition of the FIG. 3 stage, have been executed. Prone loop 10‴ encircles a doubled portion of the thread 3 owing to the fact that the needle 12 has taken a doubled portion of the thread 3 through it as will now be described with reference to FIGS. 6, 7 and 8.

Up-and-down movement of the needle 12 is substantially 180° out of phase with the movement of the needle 13, though the axial motions are not symmetrical about the plane of the base fabric 1, the excursion of a needle through the base fabric 1, being longer in time and displacement than the excursion away from the base fabric 1.

Figure 5:
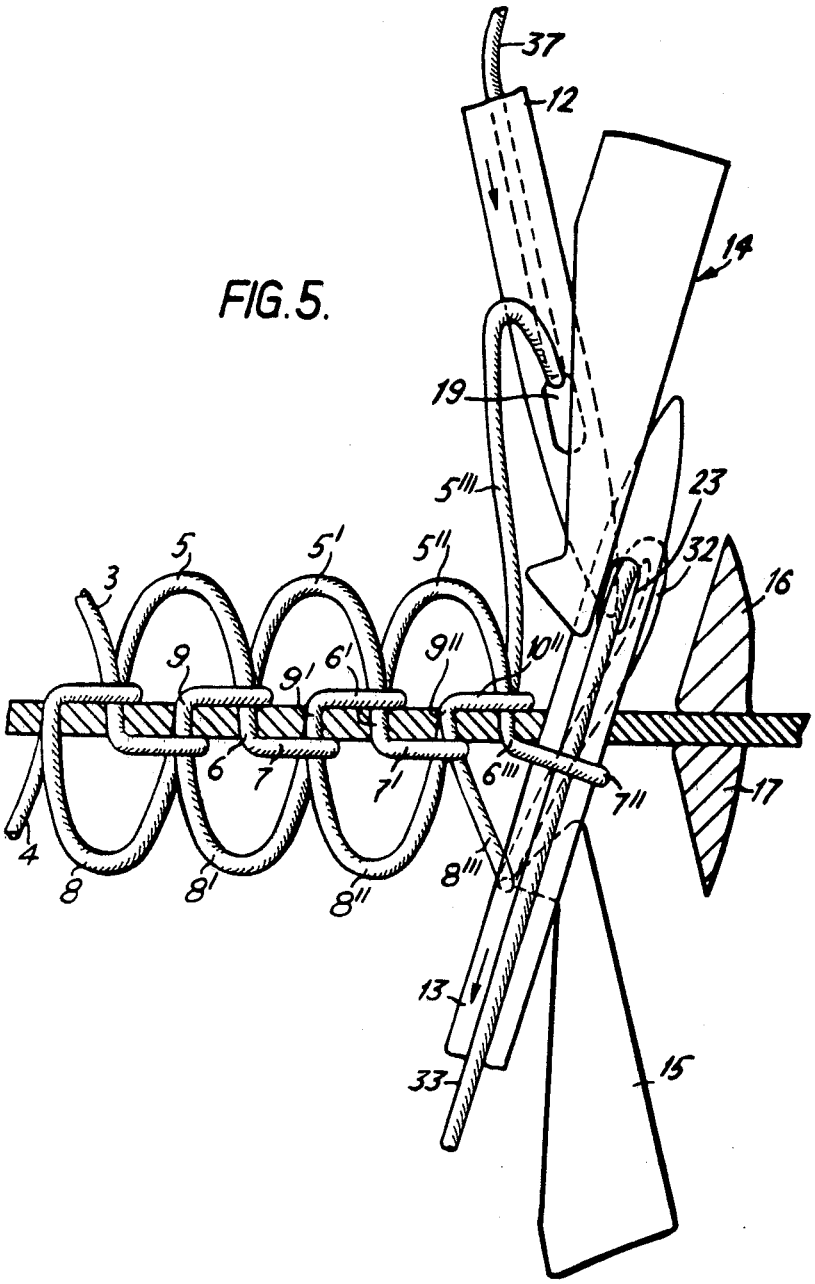
Figure 6:
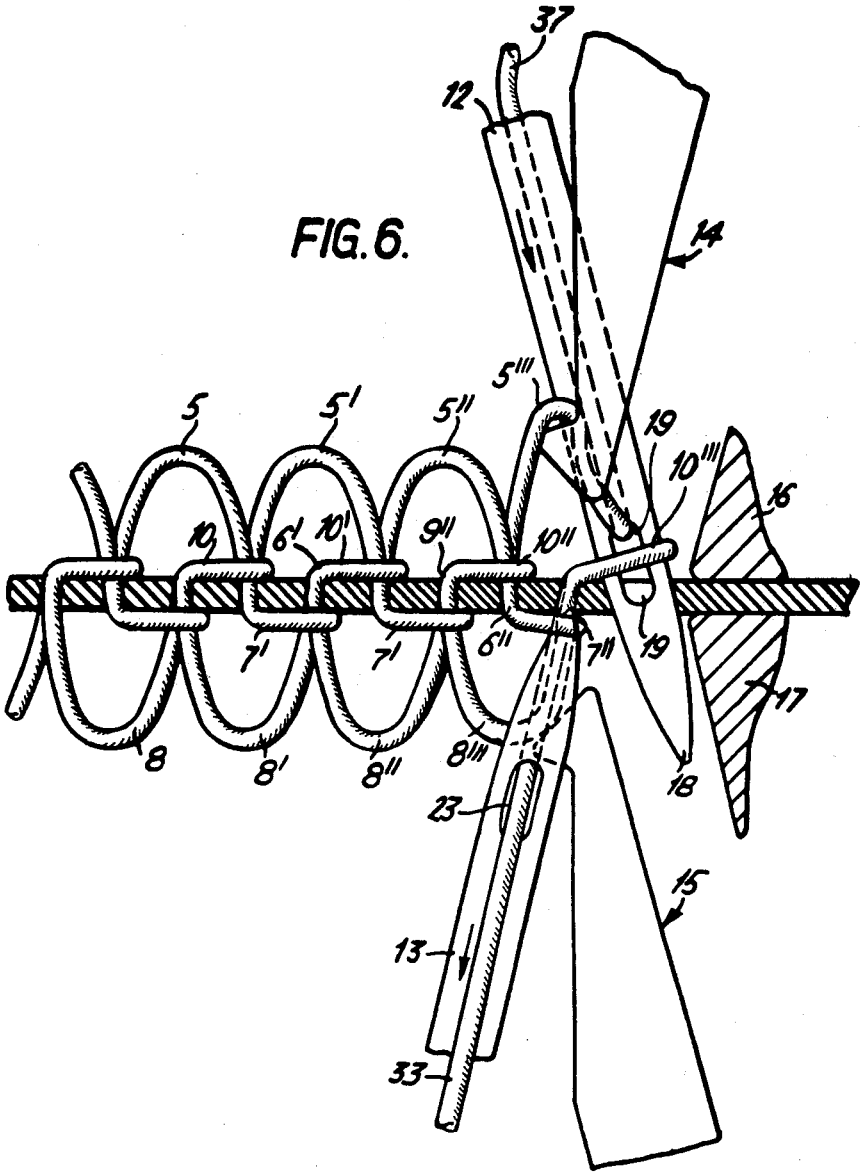
Figure 7:
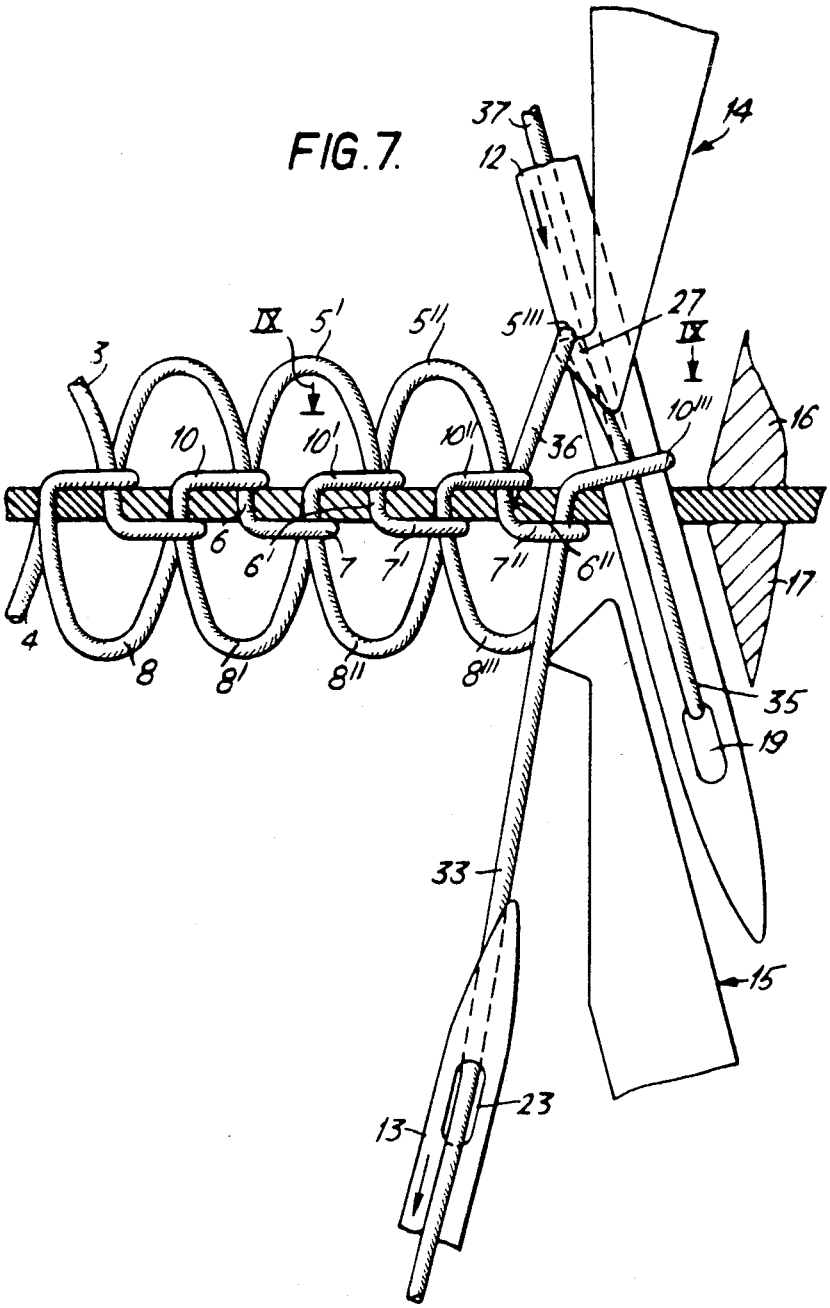

From FIGS. 5, 6 and 7 it will be seen that between the 150° position (FIG. 5) and the 180° position (FIG. 6), (i.e. at about 165°), the tip 18 of the needle 12 pierces the base fabric 1 from above (having already entered the loop 32 as above described), and thereafter downward movement of the needle 12 causes the eye 19 to carry a doubled portion of the thread 3 through the base fabric 1 (and through the loop 10‴) so that it projects below the base fabric 1 in the form of a loop 35 (FIG. 7). A length 36 of the thread 3 extends from one end of the loop 35 up through the base fabric 1 and joins an already formed doubled portion 6″ of the thread 3. A length 37 of the thread 3 extends from the other end of the loop 35 up through the base fabric 1 along the groove 21 in the needle 12 and to a thread supply (not shown).

At the FIG. 7 stage the length 36 of the thread 3 has been caught on the nib 27 of the finger 14. The finger 14 thus holds the length 36 of the thread 3 against being drawn close against the upper face of the base fabric 1, as the needle 12 moves downwards, so as to leave the length 36 (after it has moved to the left of the nose 28 of nib 27 as the base fabric 1 moves to the left) in the form of an upstanding pile loop 5‴ like the previously formed loops 5, 5′, 5″.

Referring again to the timing chart of FIG. 11 it will be seen that the needle 12, after the tip 18 has entered the base fabric 1 at about 165°, falls to its lowest position at about 270° and then moves upwards to the 330° (FIG. 8) position. Such upward movement of the needle 12 allows the loop 35 to slacken so that the needle 13 very shortly after the 330° position, in its upward movement, is able to enter the loop 35 and prevent its being pulled back up through the base fabric 1 by further upward movement of the needle 12 and by the action of take-up mechanism which operates on the length 37 of the thread 12 to tighten the loop 35 about the needle 13.

FIGS. 6, 7 and 11 show that the loop 7″ is cast off the needle approximately at the 180° position of the main shaft leaving the loop 7″ in the form of a prone loop lying along the underface of the base fabric 1. This prone loop 7″ encircles a doubled portion of the thread 17 owing to the fact that the needle 13 carries a doubled portion of the thread 4 upwards through the loop 7″ (and through the base fabric 1) in the period −15° (345°) to 90° of the cycle of the main shaft.

By repeating the cycle shown in FIGS. 3 to 8 again and again an elongated seam as illustrated in FIG. 1 can be made.

Figure 9:
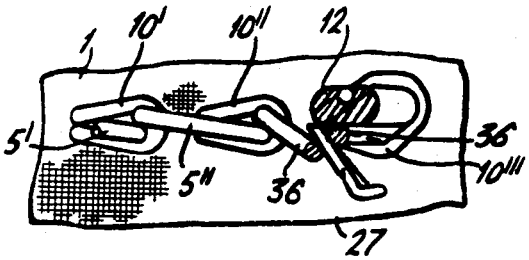
FIG. 9 shows a section through the said machine in a plane parallel to the surface of the base fabric.

FIG. 9, which is self explanatory, is a section through the machine in the FIG. 7 stage, the section plane being parallel to the surface of the base fabric 1, as indicated by the line IX — IX in FIG. 7.

The needles 12 and 13 are traversed, (the said secondary motion), along the line of the base fabric 1 in such a manner that, when a needle is piercing the base fabric, the point of intersection between a needle and the plane of the base fabric 1 is traveling at a predetermined constant rate of advance of base fabric 1, from right to left in FIGS. 3 to 8. After the point of a needle has disengaged from the base fabric and before again piercing the base fabric, the needle must recoil to the right as seen in FIGS. 3 to 8. In fact the needle must decelerate from the said constant rate of advance during a short finite period immediately after disengaging from the base fabric and must again accelerate to the said constant rate before again piercing the base fabric, since infinite deceleration and deceleration is not possible, the recoil stroke of the secondary needle motion therefore involves movement over a longer distance in a shorter time, than is the case with the advance stroke of secondary needle motion. It is furthermore necessary so to time the recoil stroke of one needle with the advance stroke of the other needle that the recoiling needle is in the correct position to penetrate the loop in the eye of the other needle which is then advancing in its secondary motion. Without this secondary motions of the needles their axes would have to intersect the base fabric along a line running weftwise of the base fabric and one needle could not readily pass through a slack loop of the other (to form a prone loop) without the provision of a third member to engage the slack loop from a needle extending through the base fabric, and carry that slack loop into the path of the other needle about to pierce the base fabric. The mechanism of FIG. 12 is designed to provide the required primary and secondary motions to the needles of a needle pair but alternative mechanisms could be used of course, including the said third member for engaging the said slack loop.

Figure 12:
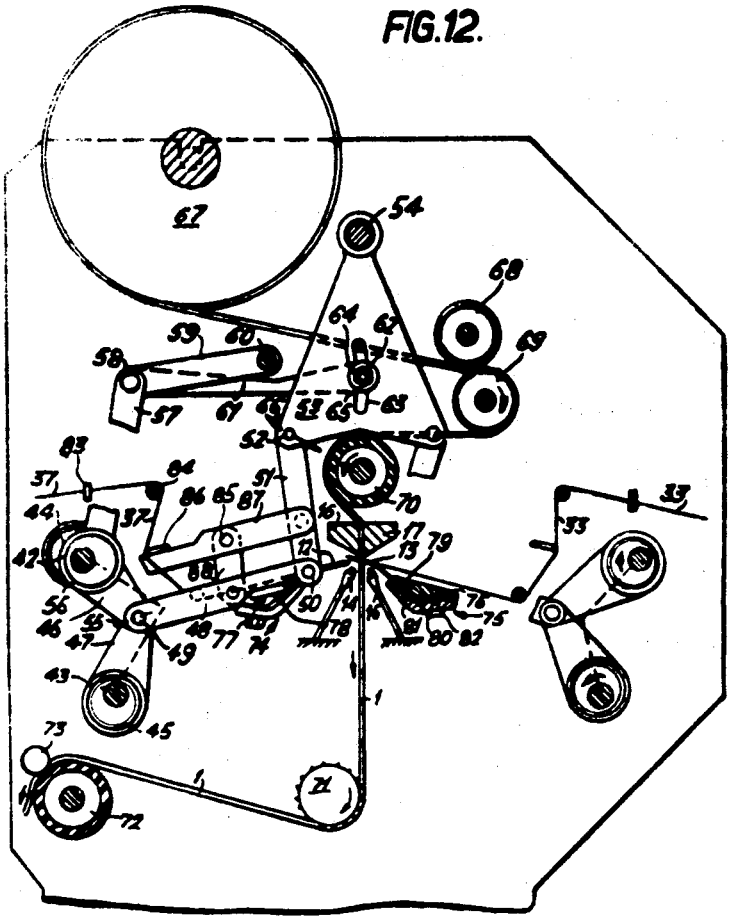
FIG. 12 shows, somewhat diagrammatically, the mechanism for actuating the needles of the said machine.

A mechanism for actuating the needles 12 and 13 which are only one of a number of similar needle pairs arrayed in line abreast across the width of the base fabric 1, is shown in FIG. 12.

The mechanism of FIG. 12 is designed for feeding the base fabric 1 vertically from top to bottom through the tufting zone so that the right hand side of FIGS. 3 to 8 is at the top and the upper needle 12 is on the left. Comparison of FIG. 12 with FIGS. 3 to 8 is facilitated by rotating FIG. 12 clockwise through 90°.

The mounting and actuating mechanism for one needle of the pair is the mirror image of the corresponding mechanism for the other needle so only the mechanism associated with needle 12, on the right in FIG. 12, will be described.

Two shafts 42 and 43, journalled in fixed parts of the machine, are geared together for contra-rotation at the same speed and carry respectively eccentrics 44 and 45. The sheaves of these eccentrics are unitary respectively with connecting rods 46 and 47, the outer ends of which are pivoted to one another and to a needle link 48, by a pin 49.

The end of needle link 48 remote from pin 49 is pivotted at 50 to a support link 51, the upper end of which is pivotted at 52 to one corner of a quadrant 53 which is itself pivotted at 54 to fixed parts of the machine.

When shafts 42 and 43 rotate, the pin 49 moves to and fro along a path 55 contained in two planes, one parallel to the axes of shafts 42 and 43, normal to a plane containing those axes and passing midway between them, the other being normal to the said axes.

The other end of needle link 48 (pivot 50) swings about the pivot point 52 on quadrant 53 and if the latter remained stationary needle link 48 would oscillate approximately along the line of its major axis. Quadrant 53 does not remain stationary however and is caused to swing about the pivot 54 in step with the shaft 42 by means of an eccentric 56, carried by that shaft, which is displaced in phase by approximately 90° in relation to eccentric 44. The sheave of eccentric 56 is unitary with a connecting rod 57, the other end of which is pivoted at 58 to a link 59 the other end of which is in turn pivoted at 60 to fixed parts of the machine. The pivot point 58 therefore moves in an arc centered upon pivot 60 on rotation of shaft 42. Pivot 58 is coupled by a link 61 to a point 62 on quadrant 53 and the distance between pivot 54 and point 62 can be adjusted by means of an arcuate slot 63 in quadrant 53, a bolt 64 defining point 62 being slidable along slot 63 on slackening a nut 65 which is tightened again after the adjustment has been made.

Pivot point 52 on quadrant 53 oscillates in an arcuate path (indicated by arrow 66) centered on pivot 54 and the phase of these oscillations in relation to the movement of needle link 48 along its major axis is such as to provide, to a close approximation, the required secondary motions of needle 12 as previously described, this somewhat complex mechanism being required in order to modify the simple harmonic motion at pivot 58 into a motion at least the downward phase of which produces substantially constant velocity at the point where needle 12 penetrates base fabric 1.

The base fabric 1 is fed from a beam 67 via rollers 68, 69 and 70 which serve as a fabric-tensioning system, roller 68 being freely rotatable and serving to press base fabric 1 against roller 69. Rollers 69 and 70 are covered with high friction material such as rubber and are equipped with brakes adjustable to regulate the back tension on base fabric 1, which passes between guide bars 16 and 17 and thence to a spiked drive roller 71 the speed of which can be adjusted in relation to that of shafts 42 and 43 to regulate the stitching density.

The base fabric 1 is conveyed from the machine via rollers 72 and 73 from which it may pass to a folding machine (not shown).

The mechanism described, for actuating needle link 48, and the similar mechanism on the right for actuating needle 13 is repeated in mirror image at the other side of the base fabric 1 and needle link 48 and its corresponding duplicate separated from it by the width of the base fabric 1, are attached to the two ends of a needle bar 74 which holds an array of closely spaced needles such as 12.

The details of this needle bar can be seen from the sectioned representation of the corresponding needle bar 75 for an array of needles such as 13 on the other side of the machine (on the right in FIG. 12). The needle bar 75 consists of a base bar 76 the ends of which are secured to the needle link in the same way as needle bar 74 is secured to needle link 48, e.g. by bolts 77, 78. Base bar 76 contains an array of holes such as 79, to receive the cranked butts 80 of an array of needles such as needle 13, and the needles are secured by a clamping bar 81 bolted to base bar 76, e.g. by bolts such as 82, at suitable intervals along needle bar 75.

FIG. 12 shows a somewhat different position for the loopers 14 and 15 from the positions of these items in FIGS. 3 to 10, which has the advantage that the loopers can be accommodated directly behind the needles of each needle pair rather than between them as is necessary when the loopers are located in the positions shown in FIG. 10. This may be an important consideration when closely spaced needle arrays are required.

The yarn feeds to the needles of a pair are similar and only that for needle 12 will be described (on the left in FIG. 12).

The yarn 37 enters from a package, (which could be a beam wound with a warp to supply an array of needles) and passes through an eye 83 and over a bar 84 running the width of and secured to the frame of the machine. Another bar 85, similarly secured, is tangent to the axis of the needle 12 and yarn 37 is caused to take a zig-zag course with a length thereof between bars 84 and 85, which lies in the path of a yarn feed bar 86.

This bar is carried by a link 87 pivoted, at one end partway along the length of link 51 and supported at an intermediate point by a parallelogram link 88 which couples intermediate points on link 87 and needle link 48.

Link 87 thus oscillates in step with needle link 48 but at rather more than half the amplitude.

Yarn feed bar 86 pulls on the thread 37 when needle 12 is retracted, and releases thread 37 when the needle advances.

We claim:

1. A method of forming a line of stitching of tufted fabric which includes continuously passing a base fabric through a tuft insertion zone, providing two needles, each with means to move the needle in turn through the base fabric so that they penetrate the fabric from opposite sides in the tuft zone, actuating the needles to move them with the base fabric when penetrating the fabric, each needle being threaded with a thread from an individual supply, causing one needle to pass a first doubled portion of its thread through the fabric at a first point of insertion, forming a portion of thread between the said point of insertion and the immediately previous point of insertion of the said one needle into a first tufting loop bridging the two said points of insertion, preventing part of the said first doubled portion from being pulled back through the fabric when said one needle is retracted so as to form a first 'double' loop on the opposite side of the fabric from said first tufting loop, causing said other needle to pass a doubled portion of the second thread through the fabric at a point less than a said first tufting loop stitch length from the insertion point of said one needle, forming a portion of thread between the latter insertion point and the immediately previous point of insertion of the said other needle into a second tufting loop portion bridging the two latter points of insertion, preventing part of said doubled portion of the second thread from being pulled back through the fabric when said other needle is retracted so as to form a second 'double' loop on the opposite side of the fabric from said second tufting loop, causing the said first 'double' loop of the first thread to embrace the adjacent parts of two adjacent tufting loops on said second thread, causing the said first 'double' loop to lie prone on the fabric so as to lie around said two adjacent parts of tufting loops substantially at the point of penetration of said fabric by said adjacent parts, causing the said second 'double' loop of the second thread to embrace the adjacent parts of two adjacent tufting loops on said first thread and causing the said second 'double' loop to lie prone on the fabric so as to lie around said other two adjacent parts of tufting loops substantially at the point of penetration of said fabric by said adjacent parts, whereby the said prone loops are anchored at the bases of adjacent tufting loops, and repeating the passing of the threads alternately through the fabric to form a line of stitching in which tufting loops appear on both sides of the base fabric.

2. A method of forming a line of stitching of a tufted fabric which includes continuously passing a base fabric through a tuft insertion zone, providing two needles, each with means to move the needle in turn through the base fabric so that they penetrate the fabric from opposite sides in the tufting zone, actuating the needles to move them with the base fabric when penetrating the fabric, each needle being threaded with a thread from an individual supply, causing one said needle to form tufting loops of its thread from one insertion point in the base fabric to the next insertion point of said one needle and so on in succession, doubling the thread at each of said insertion points in passing the said one needle through the fabric, catching part of the double to form a first 'double' loop on the far side of the base fabric, anchoring said tufting loops by catching said first 'double' loops by means of the thread of the other needle, causing said other needle to pass a doubled portion of its thread through the fabric at an insertion point between each pair of consecutive insertion points of said one needle, causing part of said doubled portion on said other needle to be prevented from being pulled back through the base fabric when the said other needle is retracted so as to form a second 'double' loop on the opposite side of the fabric from the said other needle insertion side, causing said second 'double' loop to lie prone on the fabric so as to lie around the said parts of adjacent tufting loops substantially at the point of penetration of the fabric by said adjacent parts, whereby latter loop is anchored as a prone loop at the bases of the legs of two adjacent tufting loops and repeating the passing of the needles alternately through the fabric to form a line of stitching in which tufting loops appear on one side of the base fabric.

3. A method for producing a warpwise line of stitching of a tufted fabric, comprising:

(a) continuously advancing a base fabric at a substantially constant speed through a fabric position in a tuft insertion zone;

(b) supporting a first needle on one side of said fabric position;

(c) driving the support for the first needle in adjustable speed relation to the rate of advancement of the fabric, to pass the first needle from one side of and through the fabric position and back again so that, at least when the first needle reaches the fabric position and beyond, it has a component of motion warpwise of the fabric that is equivalent to the rate of advancement of the fabric;

(d) supporting a second needle on the opposite side of said fabric position, (e) during the support for the second needle in adjustable speed relation to the rate of advancement of the fabric, in the following relation to driving step (c):

the second needle is fed from the opposite side of and through the fabric position and back again alternately with the first needle so that, at least when the second needle reaches the fabric position and beyond, the second needle has a component of motion warpwise of the fabric that is equivalent to the rate of advancement of the fabric;

(f) the driving of steps (c) and (e) being oriented to provide the following relation: the general directions of feed and retraction of the respective needles being inclined to each other and against the direction of fabric advance through the fabric position;

(g) catching the thread of said one needle in the travel of said one needle in its motion to and from said fabric position at a site in the vicinity of said tuft insertion zone;

(h) arranging each of the two needle supports to cause the point of the traveling needle to pass in the vicinity of the eye of the other needle, or between that eye and the fabric position as the said other needle is retracting in the respective motions of the needles and, when the point of the said traveling needle reaches the fabric position, the other needle support being arranged to cause its needle to be retracted to its side of the fabric position, so that in use the thread of one needle is caught by the other needle to form a loop around the position in a fabric occupied by the other needle in its passage through the fabric when the latter is being fed through the apparatus whereby, in use, the threads of the two needles will form loops lying prone on each side of a fabric passing said fabric position, with tufting loops extending on at least one side of the fabric from one prone loop to the next on that side.

* * * * *

UNITED STATES PATENT OFFICE

CERTIFICATE OF CORRECTION

Patent No. 4,103,636 Dated August 1, 1978

Inventor(s) Gerald Frank Ward; Gordon Richard Wray

It is certified that error appears in the above-identified patent and that said Letters Patent are hereby corrected as shown below:

Item [30] The filing date of the Foreign Application is --January 10, 1969--.

In the Abstract

Line 1 of its text, change "Apparatus" to --Method--.

Column 1, line 9, change "machine" to --method--;

lines 18 and 19, change "apparatus" to --a method--;

UNITED STATES PATENT OFFICE
CERTIFICATE OF CORRECTION

Patent No. 4,103,636 Dated August 1, 1978

Inventor(s) Gerald Frank Ward; Gordon Richard Wray

It is certified that error appears in the above-identified patent and that said Letters Patent are hereby corrected as shown below:

line 29, before "machine" insert --method is described as performed using a--.

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*